US007837359B2

(12) United States Patent
Danek et al.

(10) Patent No.: US 7,837,359 B2
(45) Date of Patent: Nov. 23, 2010

(54) LENS SYSTEM FOR LED LIGHTS

(75) Inventors: Joshua M. Danek, Holland, MI (US); Thomas J. Veenstra, Zeeland, MI (US)

(73) Assignee: Innotec Corporation, Zeeland, MI (US)

( * ) Notice: Subject to any disclaimer, the term of this patent is extended or adjusted under 35 U.S.C. 154(b) by 2 days.

(21) Appl. No.: 12/100,016

(22) Filed: Apr. 9, 2008

(65) Prior Publication Data

US 2008/0247173 A1 Oct. 9, 2008

Related U.S. Application Data

(60) Provisional application No. 60/910,691, filed on Apr. 9, 2007.

(51) Int. Cl.
*F21V 5/02* (2006.01)

(52) U.S. Cl. ..... 362/309; 362/336; 362/337; 362/339

(58) Field of Classification Search ..... 362/296.01, 362/307–310, 296.05, 296.07, 296.1, 311.12, 362/327–329, 335–340, 343, 347
See application file for complete search history.

(56) References Cited

U.S. PATENT DOCUMENTS

| | | | | |
|---|---|---|---|---|
| 2,254,962 | A * | 9/1941 | Bitner et al. | 362/327 |
| 6,536,923 | B1 * | 3/2003 | Merz | 362/327 |
| 6,724,543 | B1 * | 4/2004 | Chinniah et al. | 359/718 |
| 7,270,454 | B2 * | 9/2007 | Amano | 362/522 |
| 2006/0120085 | A1 * | 6/2006 | Hsieh et al. | 362/338 |

* cited by examiner

*Primary Examiner*—Thomas M Sember
(74) *Attorney, Agent, or Firm*—Price, Heneveld, Cooper, DeWitt & Litton, LLP

(57) ABSTRACT

An optical device for distributing light produced by a white LED or other light-producing device includes a lens portion that refracts the light to provide a desired light intensity distribution, and a collimating portion that internally reflects light from the white LED. The optical device may be molded from an acrylic polymer material or the like. The reduced thickness of the device facilitates low cycle times and reduces warpage or other distortion that would otherwise be generated during the molding process.

4 Claims, 9 Drawing Sheets
(4 of 9 Drawing Sheet(s) Filed in Color)

LENS SYSTEM FOR LED LIGHTS

CROSS-REFERENCE TO RELATED APPLICATIONS

This application claims the benefit of U.S. Provisional Application No. 60/910,691, filed on Apr. 9, 2007, entitled LENS SYSTEM FOR LED LIGHTS, the entire contents of which are incorporated herein by reference.

BACKGROUND OF THE INVENTION

"White" LEDs have been used in numerous devices/applications such as flashlights, task lights for motor vehicles and the like. White LEDs generally include a blue LED with a phosphor coating that emits yellow light which mixes with the blue light to provide light that is perceived to be primarily white, with a slight bluish tint. Another type of white LED utilizes a combination of blue, red, and green LEDs to produce white light. Due to the efficiency of white LEDs, the use of white LEDs in applications such as vehicles and the like having a limited supply of electrical power has been increasing.

Although the light produced by a white LED has a color that is acceptable for task lights and the like, the light is typically not focused enough to provide efficient lighting for such applications. Various lenses, reflectors, collimators and the like have been developed to focus or direct the light from LEDs. Referring to FIG. 1, a prior art collimator 10 includes a body 11 made of a polymer material. The body includes a flat end surface 12 and tapered side surfaces 13 that gives the collimator 10 a generally conical shape. A cavity 14 has a generally cylindrical side surface 15, and an open end 16 that receives white LED 17. A convex surface 18 faces the white LED 17. The light from white LED 17 incident upon cylindrical sidewall 15 refracts from the tapered side surfaces 13, and exits the collimator 10 through flat end surface 12. The convex surface 18 reflects light internally from white LED 17 and directs the light through flat end surface 12.

The collimator 10 of FIG. 1 produces a light intensity distribution curve 19 illustrated in FIG. 2. Thus, although collimator 10 does direct the light in a beam, the light intensity distribution is quite uneven. Also, although white LEDs generally produce a light having a color suitable for use as a task light and the like, white LEDs tend to produce light having a yellowish tint at the peripheral edges of the light pattern.

Accordingly, a way to direct and focus light from a white LED in an efficient manner would be advantageous.

SUMMARY OF THE INVENTION

The present invention relates to an optical device that utilizes both internal reflection and refraction to distribute light from a white LED or the like. The optical device includes a body made of a light-transmitting material. The body includes a cavity that receives light from a light source such as a white LED. The cavity includes sidewall surfaces that are cylindrical or conical, and a base surface that is preferably flat. The device further includes a tapered rear surface extending outwardly away from the cavity. The tapered surface is configured such that light incident upon the tapered surface from the cylindrical sidewall of the cavity is reflected internally. The device further includes an outer end surface opposite the cavity and tapered surfaces. The end surface includes a center portion forming a lens, and outer portions that are generally flat. Light reflected internally by the tapered rear surface is directed through the outer flat surface portions. The flat surface portions are configured to transmit light without significant refraction. The lens surface portion preferably includes a convex center portion, and a plurality of concentric ridges forming a Fresnel lens portion.

The intersection between the cylindrical sidewalls of the cavity and the base surface of the cavity forms a transition point. Light emitted into the cavity by a white LED that is incident upon the base surface of the cavity is refracted such that the light exits the lens portion of the opposite surface. Light that is incident upon the cylindrical sidewalls of the cavity is reflected off the tapered surfaces and through the flat outer concentric surface portions.

The lens portion of the opposite surface and of the concentric flat portion, along with the tapered surface, are configured such that the light reflected internally is reflected back towards the center of the lens, thereby directing the yellow light from the edges of the LED back into the main portion of the light pattern. In this way, the device not only produces a light pattern having a relatively uniform light intensity, but also directs the yellow light back towards the center of the light pattern, thereby eliminating the uneven color distribution found with other collimator systems. The optical device may be molded from a suitable polymer such as an acrylic material. The unique shape of the optical device provides a thin cross section, having the overall shape of a flat dish. Because the device is quite thin, mold cycle times for fabricating the part can be substantially reduced, thereby reducing the cost of the optical device. Also, the relatively thin cross section of the device substantially reduces the imperfections such as "sinks" or the like that could otherwise be caused by shrinking, warping, and the like during the molding process.

The device of the present invention includes a reflective, collimating portion that directs light emitted transversely from the LED, and a lens portion that distributes and focuses the light projected forwardly from the LED. The device provides a light pattern having a uniform intensity distribution. Still further, the device blends the yellowish portion of the light pattern produced by the LED back into the center portion of the light pattern, thereby providing a substantially uniform color across the light pattern.

These and other features, advantages, and objects of the present invention will be further understood and appreciated by those skilled in the art by reference to the following specification and appended drawings.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF PREFERRED EMBODIMENT

Figure 3:
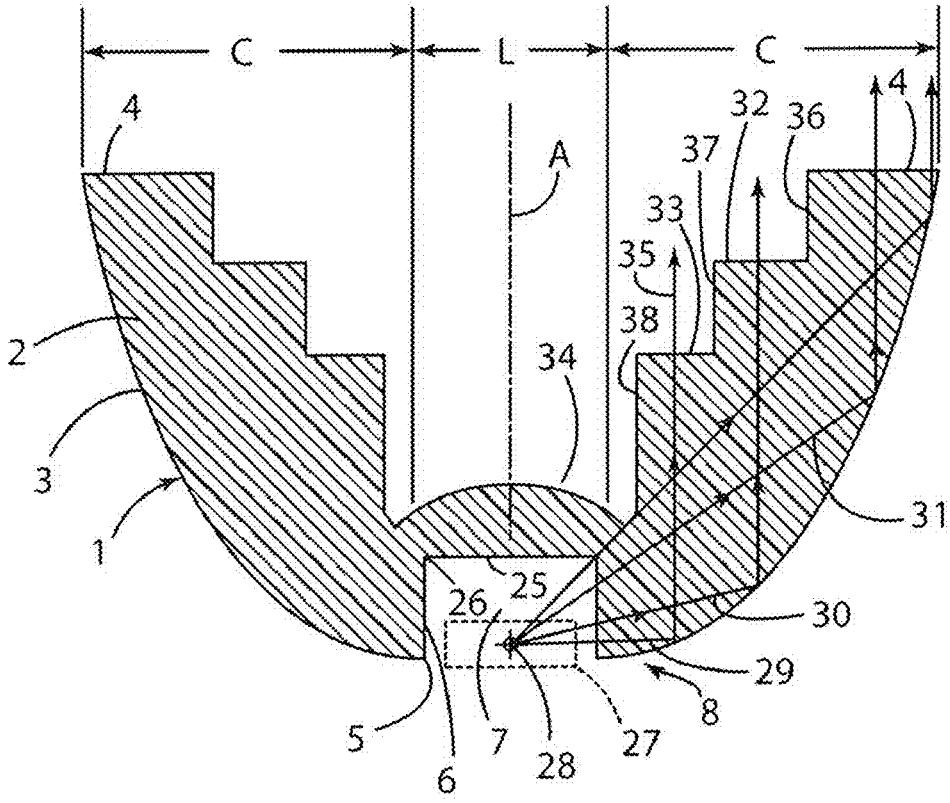
FIG. 3 is a cross-sectional view of an optical device according to one aspect of the present invention.
Figure 4:
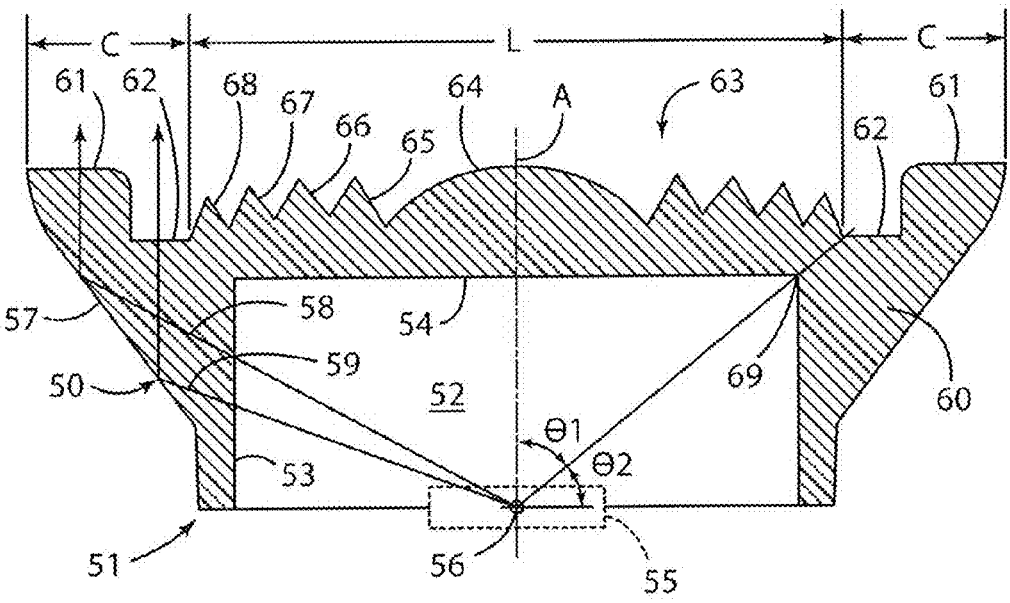
FIG. 4 is a cross-sectional view of an optical device according to another aspect of the present invention.

For purposes of description herein, the terms "upper," "lower," "right," "left," "rear," "front," "vertical," "horizontal," and derivatives thereof shall relate to the invention as oriented in FIGS. 3 and 4. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts. Hence, specific dimensions and other physical characteristics relating to the embodiments disclosed herein are not to be considered as limiting.

With reference to FIG. 3, an optical device 1 according to one aspect of the present invention includes a body 2 made of a transparent acrylic material, or other suitable light-transmitting material. The body 2 includes a tapered outer surface 3 extending from an edge 5 to concentric end surface 4. Edge 5 is formed by the intersection between tapered outer surface 3 and a cylindrical sidewall surface 6 of a cavity 7 at a base end 8 of body 2. The body 2 is symmetrical about a centerline "A," such that surface 4 has a ring-like shape. Cavity 7 includes a base surface 25 that intersects the cylindrical sidewalls 6 at a circular corner or edge 26. A white LED 27 is positioned in, or immediately adjacent to, cavity 7, and provides a light source or point 28. Although LED 27 does not actually produce light from a single point, the white LED 27 will be treated as if it produces light from a single point 28 in order to facilitate discussion of device 1. In the illustrated example, surface 25 is planar. However, surface 25 may be non planar (e.g. convex) also.

The light incident upon sidewall surface 6 of cavity 7 and reflected internally by tapered surface 3 is collimated, defining a ring-like collimating portion designated "C." Light from LED source 28 that is incident upon surface 25 of cavity 7 is refracted through a lens surface 34 forming a lens portion "L" at the center of device 1. Light rays 29, 30 and 31 produced by white LED 27 are incident upon the cylindrical sidewall surface 6 of cavity 7. The light rays 29, 30 and 31 travel through the body 2 and reflected internally by the tapered outer surface 3. In addition to the surface 4, body 2 includes ring-like surfaces 32 and 33. The ray of light 29 is reflected off tapered surface 3, such that it travels through body 2 and exits at surface 33. Light ray 30 is reflected internally by tapered surface 3, and exits through surface 32. Light ray 31 is reflected internally from tapered surface 3, and exits through flat surface 4. Sidewall surface 6 of cavity 7 may be cylindrical, or curved or tapered somewhat, and may form a frustum such as a shallow truncated cone. Although cavity 7 preferably has a cylindrical or truncated cone shape, it will be understood that other shapes may also be utilized to provide the required light intensity distribution. Surfaces 6 and 3 are configured such that light incident upon surface 6 from white LED 27 reflects internally from tapered surface 3, and exits through one of the concentric surfaces 4, 32 or 33. Surfaces 4, 32 and 33 are perpendicular to the axis A, or at a slight angle thereto. Surfaces 4, 32 and 33 may be flat, or they may be curved or shaped slightly if desired to provide a particular light intensity distribution. In a preferred arrangement, surfaces 4, 32 and 33 are flat to minimize the refraction of light.

Light from LED 27 that is incident upon base surface 25 of cavity 7 is refracted and travels through body 2, and exits at convex lens surface 34. The base surface 25 of cavity 7 and the convex lens surface 34 together define lens portion L of the device 1. The corner or edge 26 formed by the intersection of the base surface 25 of cavity 7 and the sidewall surface 6 of cavity 7 defines a transition point between the lens portion L and the collimating portion "C" of the device 1. It will be apparent that the shape of the concentric lens 34 can be selected to provide a desired distribution of light. Similarly, the tapered outer surface 3 and the sidewall surface 6 can also be selected to collimate and distribute light from LED 28 in a desired manner.

The ring-like surfaces 32 and 33 are preferably spaced inwardly from surface 4, with cylindrical sidewall portions 36, 37 and 38 extending between the surfaces 4, 32, 33 and the lens surface 34. This configuration reduces the overall thickness of the body 2, thereby reducing the cycle time required to mold the device 1. Furthermore, the reduced thickness reduces or eliminates distortions, warping, and the like that would otherwise result during the molding process.

With further reference to FIG. 4, an optical device 50 according to another aspect of the present invention has a generally flat dish-like shape that is symmetrical about a centerline A. Optical device 50 has a base end 51 with a cavity 52 having a sidewall 53 and a base wall 54. Sidewall 53 is preferably a frustum such as a truncated cone forming an angle of about three degrees relative to axis A. Sidewall 53 may also have curved shape, and need not form a frustum. In the illustrated example, base surface 54 is flat, and has the shape of a circle. However, surface 54 may also be non-planar (e.g. convex). A white LED 55 provides a source of light that is positioned at point 56. White LED 55 is treated as if it were a point source of light 56 for purposes of the present description, but it will be readily understood that the white LED 55 is not a single point of light.

A tapered outer surface 57 internally reflects light from the LED that is incident upon cavity sidewall surface 53. For example, light rays 58 and 59 are incident upon the sidewall surface 53 of cavity 52, and reflected internally from tapered surface 57 and exit at surfaces 61 and 62 by the collimating portion "C" of device 50. Surfaces 61 and 62 may be flat such that they do not substantially affect the distribution of light reflected from tapered surface 57. In the illustrated example, surface 62 is positioned closer to end 51 of device 50 to thereby reduce the amount of material required to mold the optical device 50.

Light from point 56 that is incident upon surface 54 of cavity 52 is refracted to a lens surface portion 63 of device 50 formed in the lens portion "L" of device 50. Lens surface portion 63 includes a convex lens surface portion 64 at the center thereof, and a plurality of concentric ridges 65-68 that form a Fresnel lens portion. Light exiting the lens surface portion 63 is refracted to provide the desired light distribution by the convex lens surface 64 and the Fresnel lens formed by concentric ridges 65-68. A circular corner or edge transition 69 is formed at the corner between sidewall surface 53 and base wall surface 54. Light incident upon the sidewall surface 53 is reflected internally by tapered outer surface 57, and exits through a flat surface 61 or 62. However, light incident on surface 54 on the other side of the transition 69 is refracted internally, and distributed by the lens surface 63. The shape of lens surface portion 63 may be selected to provide a desired light distribution (intensity).

The design of the device 50 will vary depending upon the particular application and light intensity distribution desired. Nevertheless, the angle $\theta_1$ between the axis A and the transition point 69 will be about sixty degrees. Although the angle $\theta_1$ may be somewhat larger or smaller than sixty degrees, it will be apparent to those skilled in the art that light incident upon surface 54 may not refract completely at greater angles (depending, of course, upon the refractive index of the material used to form device 50), such that angle $\theta_1$ is preferably not substantially greater than sixty degrees. Conversely, if the angle $\theta_1$ is substantially smaller than sixty degrees, the amount of light from white LED 55 that is directed through the lens portion L is relatively small. Because the lens portion L provides control over the light intensity distribution, control of the total light intensity distribution is facilitated by having a relatively large percentage of the light produced by the LED refracted through lens portion L.

Figure 5:
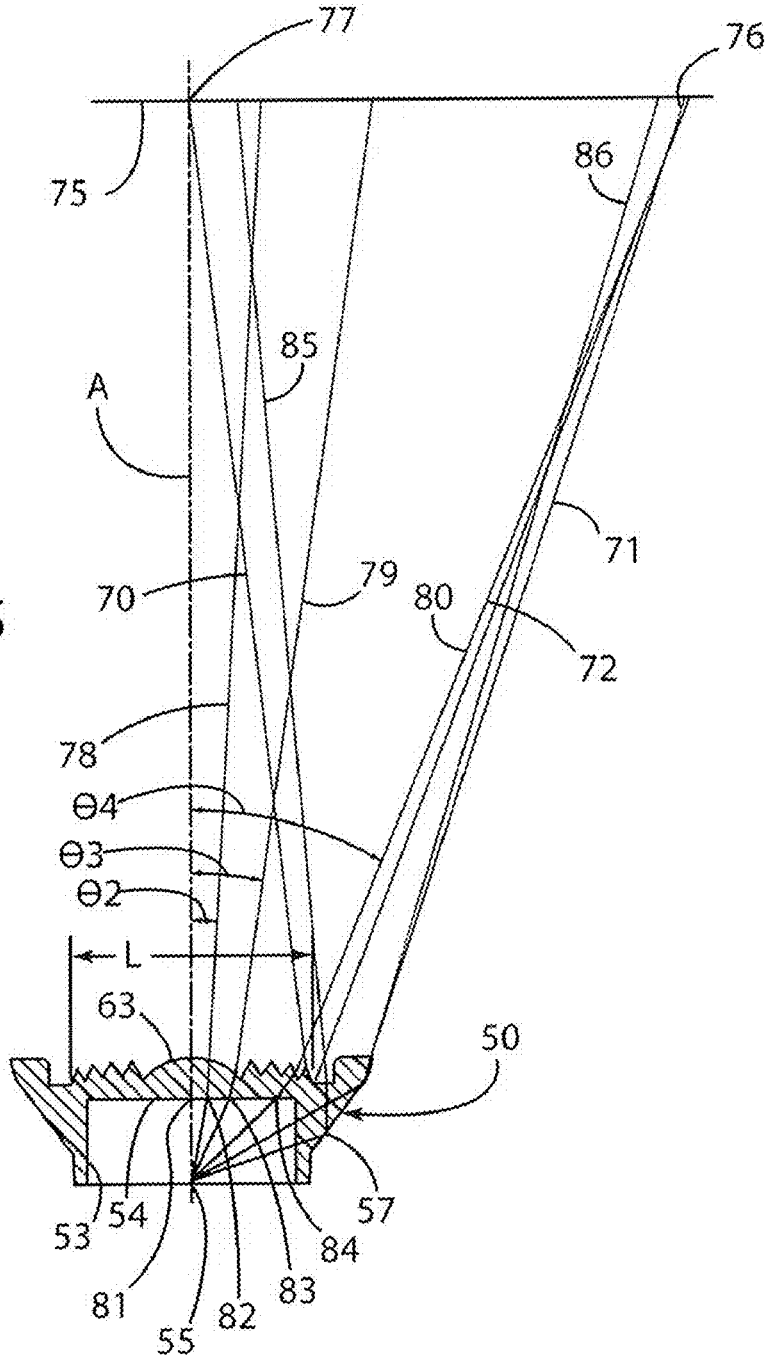
FIG. 5 is a view of the device of FIG. 4, showing the light distribution pattern.

With further reference to FIG. 5, light that is incident upon sidewall 53 and reflected internally through tapered outer surface 57 is directed by collimating portion C of device 50 in a pattern bounded by lines 70 and 71. Light that is incident upon base surface 54 of cavity 52 is directed from the lens surface portion 63 in a pattern bounded by the line 72. At an optimal distance from a surface 75, the lines 71 and 72 intersect at a point 76, and the line 70 intersects the axis A at a point 77. In general, the light emitted from the collimating portion "C" (FIG. 4) of device 50 will tend to have yellowish tint due to the yellow tint of the light produced by the white LED that is directed outwardly onto surface 53 of the collimating portion C of the device 50. As illustrated in FIG. 5, this light is distributed back towards the center point 77 of the light distribution pattern, thereby alleviating or eliminating the yellow tint that would otherwise occur around the peripheral edges of the light pattern. Also, the shape of the lens surface portion 63 and the tapered surface 57, as well as the cavity surface 53 and 54, are selected to distribute the light in a pattern that has a substantially uniform intensity distribution. It will be understood that commercially available lens design/ray tracing software may be utilized to design the exact shape of the device 50 as required for a particular application.

Examples of the distribution of light from lens portion 63 is shown by lines 78-80. Ray of light 78 from LED contacts surface 54 at a point 82, ray of light 79 contacts surface 54 at a point 83, and ray 80 contacts surface 54 at a point 84. The rays 78-80 form angles $\theta_2$, $\theta_3$, and $\theta_4$ respectively, relative to the centerline A. Thus, light incident on surface 54 further from center point 81 is distributed outwardly by lens portion 63 at increasingly larger angles relative to the centerline A to thereby distribute light outwardly towards the outer portion of the light distribution pattern. In contrast, the collimating portion C of device 50 functions such that light from LED 55 that is incident on surface 53 is refracted from surface 57, and a ray 85 is distributed back towards the center point 77, whereas a ray 86 is distributed towards the outer portion of light distribution pattern shown at the point 76. Thus, light from LED 55 distributed by the collimating portion C of device 50 is directed closer to the center of the target if the rays of light are at a greater angle relative to centerline A to thereby distribute light having a yellow tint towards the center of the light distribution pattern. Thus, the collimating portion of device 50 distributes light back towards the center of the light distribution pattern, rather than distributing light further towards the outer portion of the pattern.

Figure 6:
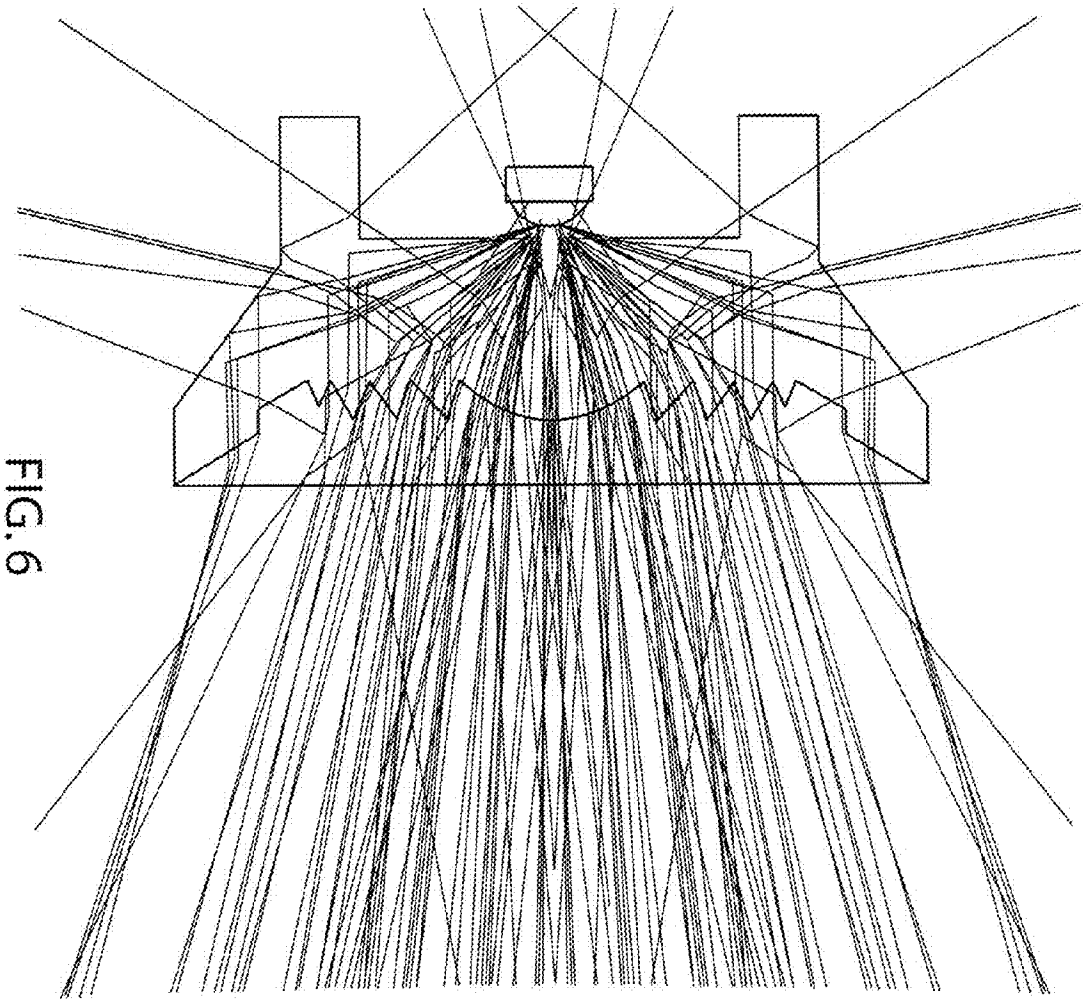
FIG. 6 is a side view of the device of FIGS. 4 and 5 showing ray traces for light produced by a light source adjacent the optical device.
Figure 7:
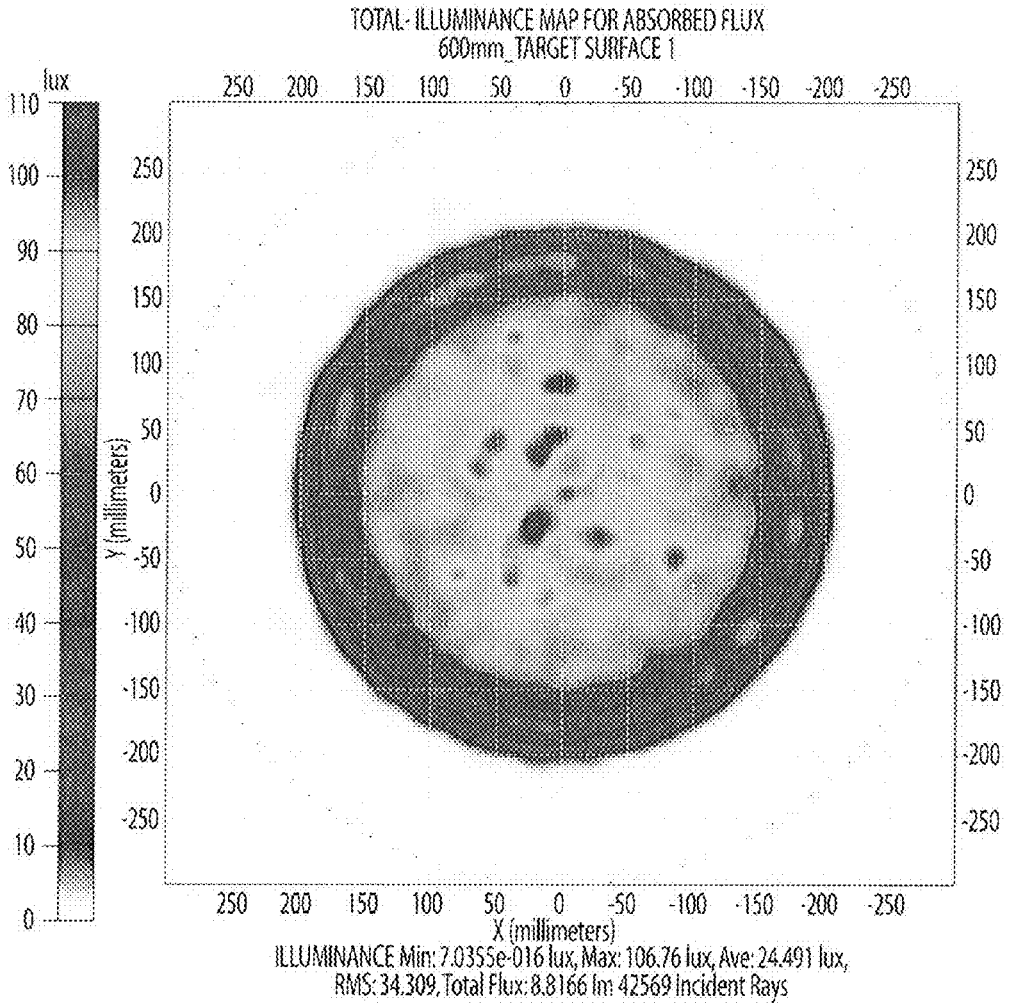
FIG. 7 is a color graph showing the light intensity distribution of an optical device according to one aspect of the present invention.
Figure 8:
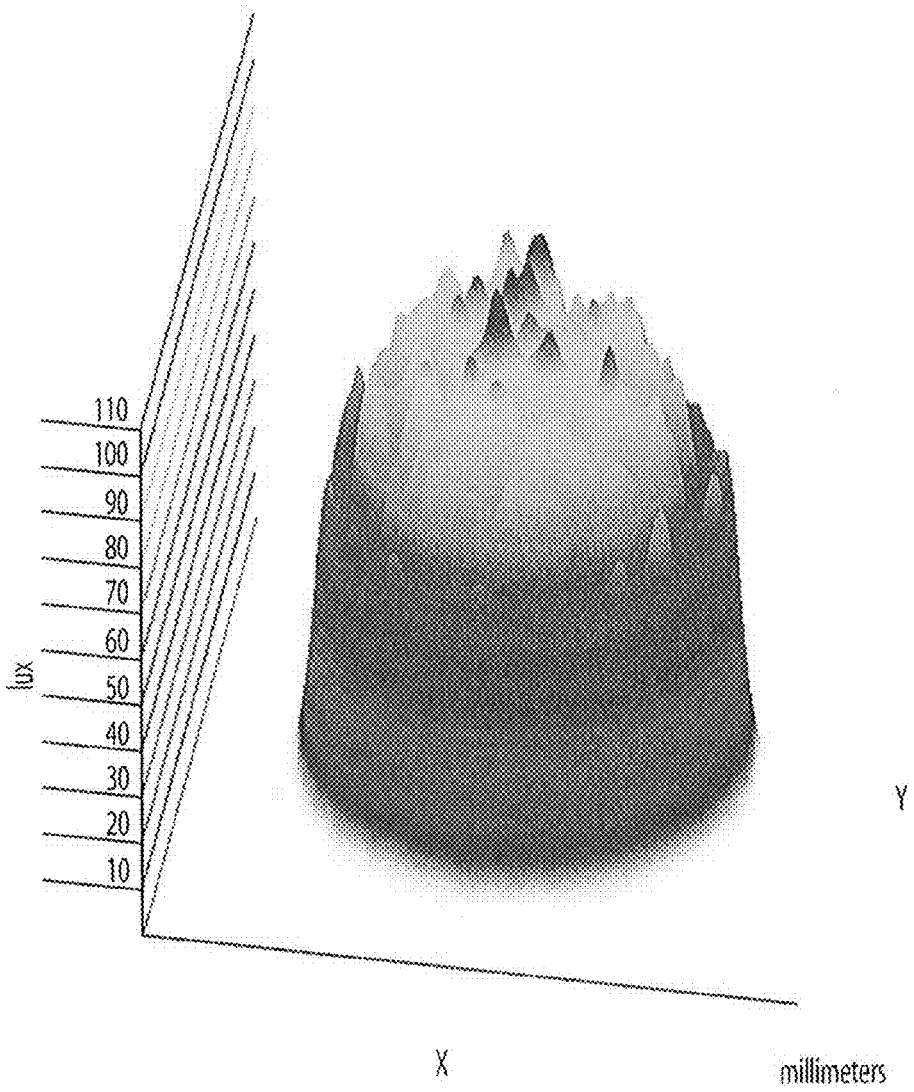
FIG. 8 is a three-dimensional color graph of the light intensity distribution of an optical device according to one aspect of the present invention.
Figure 9:
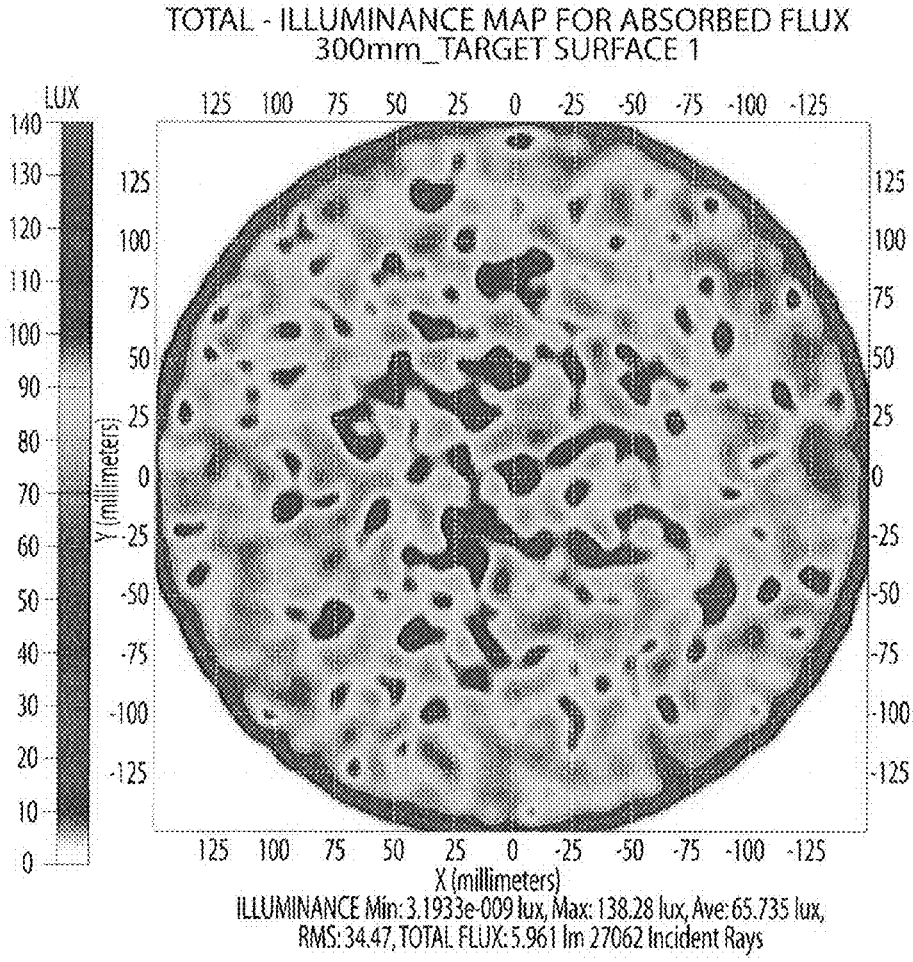
FIG. 9 is a color graph showing the light intensity distribution for an optical device according to the present invention.
Figure 10:
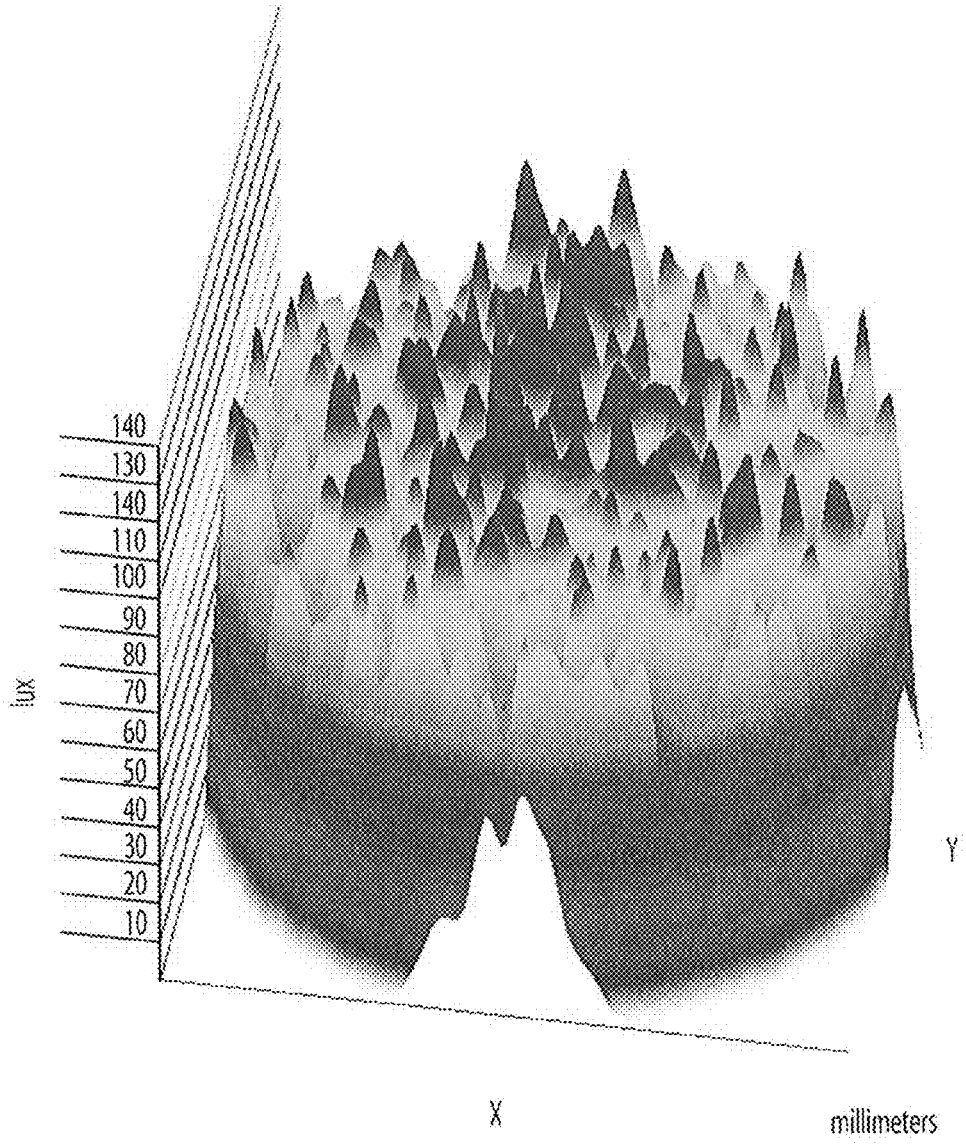
FIG. 10 is a three-dimensional color chart of the light intensity distribution of an optical device according to the present invention.

FIG. 6 shows a ray tracing simulation of a device according to FIG. 4. FIGS. 7-10 show simulated light intensity distributions of devices according to the present invention. One example of such commercially available software is Trace Pro® software, available from Lambda Research Corporation of Littleton, Mass. The light intensity patterns shown in FIGS. 7-10 are the result of a commercially available ray tracing program utilized to design and model the lens 50. As shown in FIGS. 7-10, the device of the present invention provides a light intensity distribution that is substantially more uniform than the pattern produced by known collimators and the like. FIGS. 7 and 8 show the entire illuminance map for a lens according to the present invention, and FIGS. 9 and 10 show a close-up of a center portion of the illuminance map of a lens device according to the present invention. Testing has shown that actual devices constructed according to the arrangement shown in FIGS. 4 and 5 provide a very uniform light intensity distribution. The actual devices may have a slightly different light distribution than the simulated light distributions shown in FIGS. 7-10 due to imperfections in the material of device 1, and/or the surface shapes of device 1 and the like. Nevertheless, the light intensity distribution of the actual devices closely corresponds to the simulated results. The light intensity distribution of the actual devices may be more uniform than the simulated results due to such imperfections. Significantly, the device of the present invention is capable of providing a light intensity distribution that is perceived to be substantially uniform to a viewer.

FIGS. 7 and 8 are the light intensity of the device/lens of FIG. 6 on a target surface having a 600 mm diameter, and FIGS. 9 and 10 are the light intensity of the device/lens of FIG. 6 on a 300 mm diameter target surface. The device of FIG. 6 is substantially the same as the optical device 50 of FIGS. 4 and 5. In the illustrated example, device 50 is designed to illuminate a target area having a diameter of 300 mm at a predetermined distance from the target surface. The target area could, of course, be larger or smaller depending upon the requirements of a particular situation. As shown in FIGS. 9 and 10, the device 50 provides a relatively uniform light intensity across the 300 mm diameter target surface. With reference to FIG. 9, other than a small band or ring directly adjacent the outer edge of the light distribution pattern, the light intensity varies from about 60 lux to about 135 lux. Furthermore, a substantial majority of the area of the light intensity pattern of FIG. 9 is about 80 lux to about 100 lux.

Figure 1:
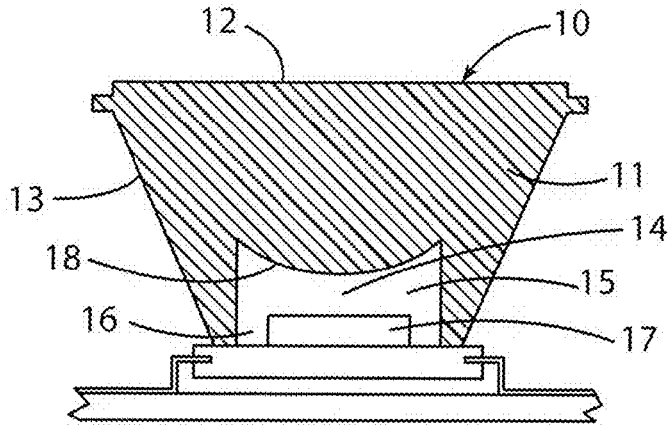
FIG. 1 PRIOR ART
FIG. 1 is a partially schematic cross-sectional view of a prior art collimator and white LED.
Figure 2:
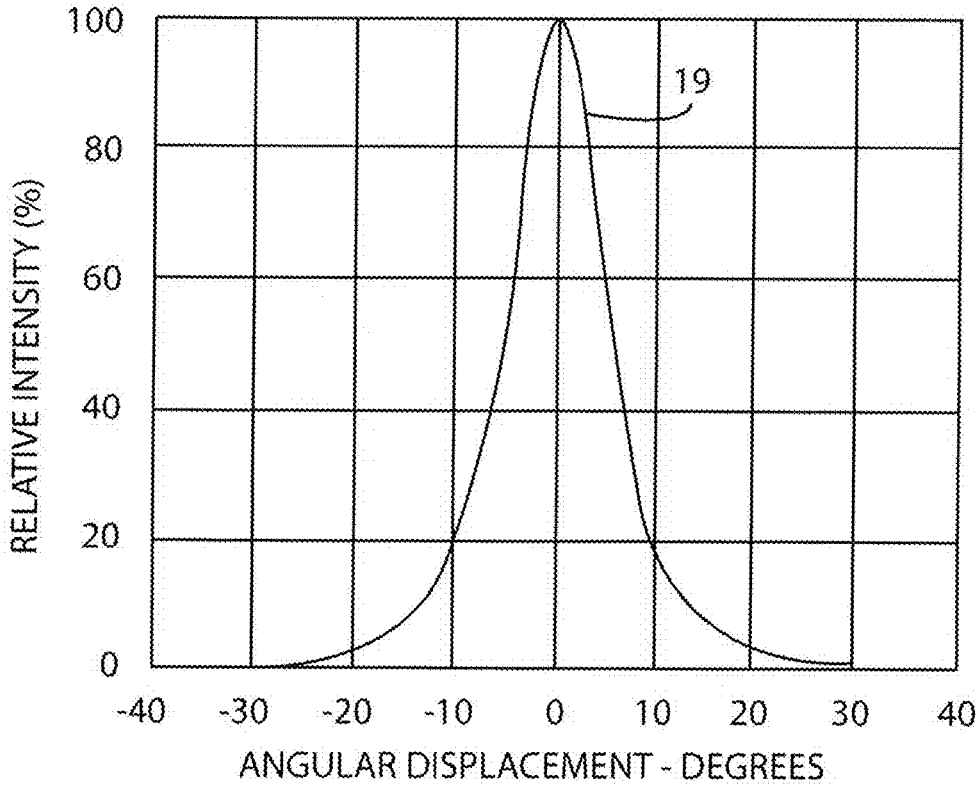
FIG. 2 PRIOR ART
FIG. 2 is a graph showing a light intensity distribution of the collimator of FIG. 1.

As shown in FIGS. 7 and 8, device 50 also provides a substantially uniform light intensity distribution over a 600 mm diameter target surface. Although the light intensity is reduced somewhat around the outer edge of the 600 mm target, even at the edge portions the light intensity is relatively uniform, without the fall off found, for example, in the prior art device 10 as shown in FIG. 2. With reference to FIG. 7, the substantial majority of the light intensity pattern is about 50 lux to about 100 lux. Thus, the lens device of the present invention provides a light intensity distribution that varies by no more than about a factor of two across the majority of the area of the light intensity distribution.

It will be understood that the exact shape, size, and other features of a device according to the present invention will depend upon the size and shape of the area that is to be illuminated, as well as the distance from the light source to the work surface or other surface being illuminated. Furthermore, it will be apparent to those skilled in the art that the exact shape of the device may vary somewhat, yet still utilize the essential features of the invention, and provide substantially similar benefits to those described in connection with the devices of FIGS. 3 and 4. For example, the number of concentric ridges used to form the Fresnel portion of the lens of the device of FIG. 4 may vary, yet still provide the desired light intensity distribution, and also provide a device which can be rapidly molded.

Also, different combinations of surface shapes may be utilized to provide the required light intensity distribution. For example, if the sidewall 53 of cavity 52 (FIG. 4) is not conical or cylindrical, but rather has a curved shape, the outer surface 57 may have a different contour to "compensate" for the shape of sidewall 53 to provide the required light intensity distribution. Also, although surface 54 of cavity 52 is preferably planar, surface 54 could have a non-planar shape, and the lens surface portion 63 could have a shape that, together with a non-planar surface 54, provides a generally uniform light intensity.

The optical device of the present invention provides a cost effective way to distribute light from a white LED or other light-producing device. The device utilizes a lens portion which focuses and distributes light from the LED, and also includes a portion that reflects light internally and thereby collimates the light. An optical device according to the present invention provides a way to reduce or eliminate the yellow tint produced by white LEDs at the edges of the light pattern.

In the foregoing description, it will be readily appreciated by those skilled in the art that modifications may be made to the invention without departing from the concepts disclosed herein.

The invention claimed is:

1. A light assembly, comprising:

a LED light source;

a lens including a body defining a front side and a rear side and formed of a light-transmitting material, the rear side of the body having a generally frustum-shaped cavity defining a first inner surface portion facing the LED, wherein the first inner surface portion is generally conical, and a base inner surface portion defining a rear lens surface facing the LED, the body further defining a tapered outer surface on the rear side of the body, the body further defining a front surface on the front side of the body, the front surface including a front lens surface portion having a convex surface and a collimating front surface portion extending around the front lens surface portion, wherein the collimating front surface portion includes a ring-shaped planar portion, first and second ring-shaped planar portions, and an inwardly-facing transverse surface extending between the first and second ring-shaped planar portions; and wherein:

a first portion of the light from the LED light source travels into the body through the rear lens surface, and escapes from the front lens surface portion, a second portion of the light from the LED light source travels into the body through the first inner surface portion, is internally reflected within the body at the tapered outer surface, and escapes from the body through the collimating front surface portion, and the first and second portions of the light at least partially combine after escaping from the body and define a target area that is spaced-apart from the body, and wherein the first and second portions of the light together provide a generally uniform light intensity distribution over a substantial majority of the target area.

2. The light assembly of claim 1, wherein:

the transverse surface is substantially cylindrical.

3. A light assembly, comprising:

a LED light source;

a lens including a body defining a front side and a rear side and formed of a light-transmitting material, the rear side of the body having a generally frustum-shaped cavity defining a first inner surface portion facing the LED, wherein the first inner surface portion is generally conical, and a base inner surface portion defining a rear lens surface facing the LED, the body further defining a tapered outer surface on the rear side of the body, the body further defining a front surface on the front side of the body, the front surface including a front lens surface portion having a convex surface and a collimating front surface portion extending around the front lens surface portion;

a first portion of the light from the LED light source travels into the body through the rear lens surface, and escapes from the front lens surface portion;

a second portion of the light from the LED light source travels into the body through the first inner surface portion, is internally reflected within the body at the tapered outer surface, and escapes from the body through the collimating front surface portion;

the first and second portions of the light at least partially combine after escaping from the body and define a target area that is spaced-apart from the body, and wherein the first and second portions of the light together provide a generally uniform light intensity distribution over a substantial majority of the target area; and wherein:

the front lens surface portion includes a plurality of concentric raised ridges extending about the convex surface, and wherein the first portion of the light from the LED escapes from the raised ridges without being internally reflected.

4. A light distributing device, comprising:

a lens including a body defining a front side and a rear side and formed of a light-transmitting material, the rear side of the body having a rearwardly-facing cavity having a first inner surface portion that is generally conical, and a base inner surface portion defining a generally planar rear lens surface, the body further defining a tapered outer surface on the rear side of the body facing outwardly and rearwardly, the body further defining a front surface on the front side of the body, the front surface including a central portion defining a non-planar convex front lens surface portion, wherein the front lens surface portion includes a plurality of concentric raised ridges extending about the convex surface, the front surface further including a collimating front surface portion extending around the front lens surface portion;

wherein a first portion of light from a light source positioned proximate the cavity travels into the body through the rear lens surface, and escapes from the front lens surface portion, and a second portion of light from a light source positioned proximate the cavity travels into the body through the first inner surface portion, is internally reflected within the body at the tapered outer surface, and escapes from the body through the collimating front surface portion; and wherein:

the first and second portions of light together form a beam of light defining an area at a predefined distance from the lens, the area including a central portion comprising a substantial majority of the area, and wherein the beam of light has a light intensity distribution that is substantially uniform across the central portion of the area, and drops off sharply in a peripheral edge portion of the area extending around the central portion of the area.

* * * * *